US007901325B2

(12) United States Patent
Henderson

(10) Patent No.: US 7,901,325 B2
(45) Date of Patent: Mar. 8, 2011

(54) ATHLETIC TRAINING DEVICE

(76) Inventor: Joe Henderson, Salt Lake City, UT (US)

( * ) Notice: Subject to any disclaimer, the term of this patent is extended or adjusted under 35 U.S.C. 154(b) by 0 days.

(21) Appl. No.: 12/559,387

(22) Filed: Sep. 14, 2009

(65) Prior Publication Data

US 2010/0227738 A1 Sep. 9, 2010

Related U.S. Application Data

(60) Provisional application No. 61/096,651, filed on Sep. 12, 2008.

(51) Int. Cl.
*A63B 71/00* (2006.01)
*A61B 5/103* (2006.01)
*A61B 5/117* (2006.01)

(52) U.S. Cl. ..... 482/8; 600/595

(58) Field of Classification Search ..... 482/1, 3–9, 482/83–90; 600/300, 587, 592, 595; 601/23–36; 434/247, 255, 258; 73/172, 379.01, 379.04, 73/379.05, 865.4; 702/33, 41–44, 182–185; 705/2; 463/1, 7–8, 36; 607/49; 700/91–93
See application file for complete search history.

(56) References Cited

U.S. PATENT DOCUMENTS 5,234,392 A 8/1993 Clark
5,524,637 A 6/1996 Erickson
5,577,981 A 11/1996 Jarvik
5,785,630 A 7/1998 Bobick et al.
5,888,172 A 3/1999 Andrus et al.
6,152,854 A 11/2000 Carmein
6,152,856 A 11/2000 Studor et al.
6,336,891 B1 1/2002 Fedrigon et al.
6,563,489 B1 5/2003 Latypov et al.
6,685,480 B2 * 2/2004 Nishimoto et al. ..... 434/247
6,876,496 B2 4/2005 French et al.
6,902,513 B1 6/2005 McClure
6,916,273 B2 7/2005 Couvillion et al.
7,022,048 B1 4/2006 Fernandez et al.
7,166,064 B2 1/2007 Watterson et al.
7,217,224 B2 5/2007 Thomas
7,602,301 B1 * 10/2009 Stirling et al. ..... 340/573.1
2002/0055383 A1 * 5/2002 Onda et al. ..... 463/36
2005/0075213 A1 4/2005 Arick
2006/0229163 A1 10/2006 Waters
2006/0258515 A1 * 11/2006 Kang et al. ..... 482/83
2007/0032748 A1 * 2/2007 McNeil et al. ..... 600/595
2008/0102424 A1 5/2008 Holljes

* cited by examiner

*Primary Examiner* — Loan Thanh
*Assistant Examiner* — Oren Ginsberg
(74) *Attorney, Agent, or Firm* — Kunzler Needham Massey & Thorpe

(57) ABSTRACT

An apparatus, system, and method are disclosed for accurate measurement, compilation, and presentation of sprinting and running technique data. In one embodiment, the apparatus, system and method includes a knee pad configured to contain a knee pad sensor, a foot pad configured to contain a foot pad sensor and a main trunk that connects the foot pad and the knee pad. The knee pad sensor and the foot pad sensor sense movement near the sensors and contact to the sensors. Data from the sensors is output to a CPU. In one embodiment, the apparatus, system and method include arm sensors. The arm sensors sense arm movement of a user and report arm movement data to the CPU. In a further embodiment, the apparatus may be configured to contain a harness positioned opposite the main trunk.

23 Claims, 14 Drawing Sheets

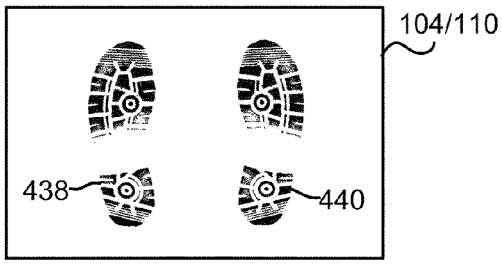
FIG. 4A
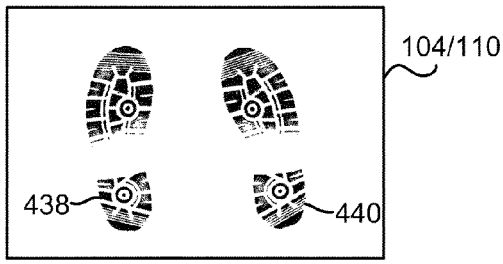
FIG. 4B
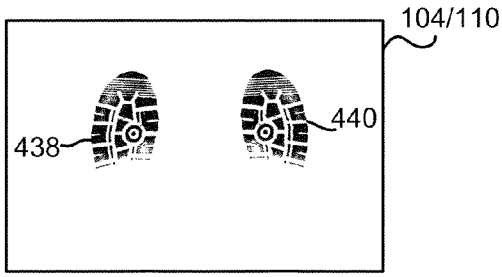
FIG. 4C
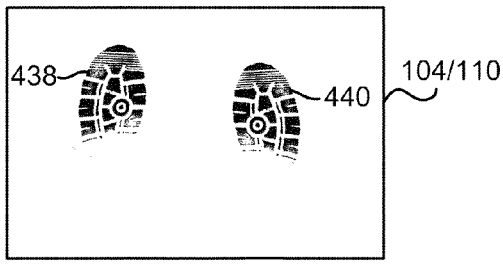
FIG. 4D
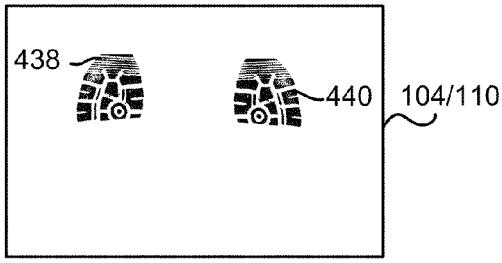
FIG. 4E
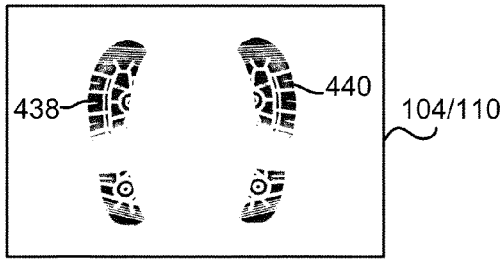
FIG. 4F
FIG. 4

ATHLETIC TRAINING DEVICE

CROSS-REFERENCES TO RELATED APPLICATIONS

This application claims priority to U.S. Provisional Patent Application No. 61/096,651 entitled APPARATUS, SYSTEM, AND METHOD FOR ATHLETIC TRAINING DEVICE, and filed on Sep. 12, 2008 for Joe Henderson, which is incorporated herein by reference.

BACKGROUND

1. Field

This invention relates to training athletes and more particularly relates to training athletes to use correct running and sprinting techniques.

2. Description of The Related Art

Running and sprinting are among the most basic and essential athletic movements for many sports. Many of the techniques required for efficiency and power in running and sprinting are initially unnatural for athletes and must be taught and practiced to achieve optimal results. In addition, improper technique in running and sprinting can result in serious injury when athletes increase power and speed while using improper techniques. Poor technique also results in poor movement efficiency, breaking forces and overloading of certain muscles and joints.

In particular, sprinting requires special techniques and skills for successful competition. Sprinting has become one of the most important criteria used by high school, college and professional sports teams in selecting players for rosters and positions. In sports such as American football, a player's speed in the 40-yard dash is a major criteria in determining the player's usefulness on the team. Sprinting is a competition where elite athletes are separated from common athletes by fractions of a second. As a result, sprinting techniques and skills are a very important part of athletic preparation.

A sprint consists of several phases which each contain specific techniques. The phases are the start phase, the drive phase and the knee lift phase (often called the acceleration phase or the maximum speed phase). The basics techniques of each of these phases are explained below. The start phase includes the first steps taken from a stopped position as an athlete starts a sprint. The athlete's body uses explosive pushing power with both legs to propel the athlete's body forward. The trunk of the athlete's body is angled forward and the arms are swung towards the athlete's forehead.

The drive phase consists of several steps taken by the athlete after the start phase. During the drive phase, the trunk of the athlete's body moves from a forward lean towards an erect position. The trunk of the athlete's body consists of the portions of the athlete's body between the athlete's waist and shoulders. The athlete's feet touch the ground in front of the athlete's center of gravity.

The knee lift phase is most recognizable by the erect positioning of the athlete's trunk. The front leg of the athlete thrusts forward and upward as quickly as possible. The feet of the athlete preferably meet the ground directly under the center of gravity of the athlete. The body weight of the athlete is balanced so the only the ball of the athlete's foot touches the ground. The hands of the athlete swing forward and up above shoulder height and back to the buttocks area. The athlete's head aligns naturally with the athlete's trunk and shoulders.

There are several aspects of running and sprinting that need to be perfected in order to achieve optimum speed and efficiency. For example, the athlete's knees should be level with the athlete's waist at the high point of the athlete's stride. This creates a drive force for each stride and insures that the athlete's leg is the shortest possible lever while the athlete moves the athlete's leg forward.

The athlete's arms, feet and knees should move in the direction of the run or sprint. Movement at an angle to the direction of the run or sprint by the athlete's arms, feet or knees creates forces that move the athlete in the angled direction and makes the run or sprint less efficient.

Even the amount of the athlete's foot that contacts the ground and the force with which the athlete's foot contacts the ground effects the efficiency of a run or sprint. In the case of a sprint, the athlete should contact the ground with as little force as possible. Also, only the forward portion of the athlete's foot should touch the ground. The athlete flexes the toes of the foot toward the athlete's shin to create a "dorsi-flexed" position. The combination of a "dorsi-flexed" position and contacting the ground with only the forward portion of the athlete's foot, helps the athlete reduce breaking forces and increase running and sprinting efficiency.

The cadence of the athlete's arms, legs and knees and the frequency of the athlete's arms, legs and knees is also important. The most efficient running form consists of a consistent cadence of the arms, legs and knees. The frequency of the stride of the arms, legs and knees determines the speed of the run or sprint. For many athletes, the frequency of the stride of the arms, legs and knees slows or fluxuates during a sprint or run. By analyzing when this happens, the athlete can performed focused training to improve those weaker areas. Also, the coordination between the arm stride, knee stride, and foot stride is essential to proper running and sprinting form.

Consistency of the power and speed used in the arms, knees, and feet is also essential. In addition to consistency between power and speed used in the arms, knees, and feet, consistency between the forward motion power and speed and the backward motion power and speed of the arms, knees and feet is essential. For example, it is essential that when the athlete's foot contacts the ground it is moving at a negative foot speed that equals the forward speed of the athlete's center of gravity. If the negative foot speed is slower than the forward speed of the athlete's center of gravity, breaking forces are present during each step of the run which seriously damage running efficiency and speed.

The athlete's posture during a run or sprint is also essential. During the knee lift phase of a sprint, the runner assumes a substantially erect posture. With the athlete's body erect, the lead foot will land under the center of mass of the body. When leaning forward, the athlete's foot will not land directly under the center of mass of the body and each step creates a slight breaking force. Several other techniques are part of proper running and sprinting technique, but each stems essentially from the movement of the feet, knees and arms and the posture of the athlete. Once proper form has been mastered, the athlete can increase the power of the knee drive, arm drive and foot drive. Increasing power before proper form has been mastered increases the likelihood of injury.

Coaches, trainers and others who work with athletes have created a plethora of training techniques and drills to try to teach athletes the proper running and sprinting techniques and skills. These training techniques and drills are successful in some areas but lack several attributes necessary for precision training and performance. For example, currently available training drills do not provide accurate measurement of key sprinting and running techniques such as height of knee lift, total knee force, average leg speed, and leg stride frequency. While these techniques can be observed generally with the naked eye, there is no accurate method to calculate and compare these techniques. Also, currently available training drills do not allow the athlete to measure key sprinting and running techniques for an extended period of time. In addition, currently available training drills do not allow the athlete to compare and coordinate techniques that must be coordinated for competition. These include coordinating arm swing and leg stride. Also, many currently available training drills must be constantly monitored by a coach or trainer to analyze results.

What is needed is a training apparatus, system and method that provide very accurate measurements of key sprinting and running techniques such as height of knee lift, total knee force, average leg speed, and leg stride frequency. The training apparatus would ideally accurately measure these techniques over a specified period of time and have the ability to compile data collected over that time. The training apparatus would ideally have the ability to compare and coordinate techniques that must be coordinated for competition. Also, the training apparatus would ideally output compiled data and provide training advice for the user.

SUMMARY

From the foregoing discussion, it should be apparent that a need exists for an apparatus, system, and method that allow for accurate measurement, compilation, and presentation of sprinting and running technique data. Beneficially, such an apparatus, system, and method would allow the athlete to view sprinting technique data and log data in a format that keeps a history of training improvement.

The present invention has been developed in response to the present state of the art, and in particular, in response to the problems and needs in the art that have not yet been fully solved by currently available sprint and running technique training drills. Accordingly, the present invention has been developed to provide an apparatus, system, and method for accurately measuring, compiling and presenting sprinting and running technique data that overcome many or all of the above-discussed shortcomings in the art.

The apparatus to accurately measure, compile and present sprinting and running technique data is provided with a plurality of modules configured to functionally execute the necessary steps of measuring data, compiling data and presenting data. These modules in the described embodiments include a compilation module to compile sensor data.

The apparatus, in one embodiment, includes a knee pad configured to contain a knee pad sensor. The knee pad sensor senses movement near the knee pad sensor and contact to the knee pad sensor. The knee pad sensor also reports movement and contact data to a CPU.

The apparatus also includes a foot pad containing a foot pad sensor. The foot pad sensor senses movement near the foot pad sensor and contact to the foot pad sensor and reports movement and contact data to the CPU. A main trunk connects the foot pad and the knee pad. In one embodiment, the foot pad is located in a horizontal plane and the knee pad is located in a parallel plane above the foot pad. The main trunk connects the foot pad and the knee pad and maintains the position of the knee pad with respect to the foot pad. In one embodiment, the location and angle of the foot pad and the knee pad are adjustable on the main trunk.

The apparatus is further configured, in one embodiment, so that the knee sensor measures knee force, knee cadence and knee frequency. The knee sensor outputs knee force, knee cadence and knee frequency data to the CPU. In one embodiment, the foot pad sensor measures foot force, foot cadence, foot frequency and foot torque. The foot pad sensor also outputs foot force, foot cadence, foot frequency and foot torque data to the CPU.

In one embodiment, the foot pad sensor senses foot position on the foot pad, foot angle on the foot pad and foot stepping area on the foot pad. In another embodiment, the foot pad sensor also measures foot torque which includes negative foot speed and force.

In a further embodiment, the apparatus may be configured to contain arm sensors. The arm sensors sense arm movement of a user and report arm movement data to the CPU. In one embodiment, the arm sensors measure arm speed, arm cadence and arm frequency and output arm speed, arm cadence and arm frequency data to the CPU. Arm speed data includes forward arm speed and backward arm speed.

In a further embodiment, the apparatus may be configured to contain a harness positioned opposite the main trunk. In one embodiment, the harness contains a harness sensor configured to report sensor data to the CPU. In one embodiment, the harness is configured to measure harness force, body trunk angle and body posture and to output harness force, body trunk angle and body posture data to the CPU. In one embodiment, there is a plurality of harnesses connected with portions of the athletes back which output a posture measurement to the CPU. Sensor data includes data output by the knee pad sensor, the foot pad sensor, the arm sensors, and the harness sensor.

In a further embodiment, the apparatus may be configured to contain a video recording mechanism. The video recording mechanism is capable of video recording and outputing real-time video of the user while the user is running or sprinting in place on the apparatus.

In another embodiment the apparatus contains a compilation module of the CPU which compiles and organizes sensor data and outputs compiled sensor data. In one embodiment, the compilation module detects user training errors such as errors detected when comparing knee pad sensor data with foot pad sensor data to measure coordination of foot and arm movement. In one embodiment, the compilation module receives sensor data from the knee sensor, the foot sensor, the arm sensors and the harness sensor and outputs user readable data comprising frequency, power, position, orientation, and coordination between feet, arms and legs. The compilation module can compile data over a specified time which may be equivalent to the time required for a sprint.

In one embodiment, the compilation module compiles data and outputs customized training advice and techniques for the user which correspond to the sensor data received by the CPU. In another embodiment, the compilation module can be set to compare frequency, force, torque and speed over a specified time period and give a percentage corresponding to the consistency of each of frequency, force, torque and speed. In another embodiment, the compilation module compares the user's sensor data to ideal sensor data for each phase of a sprint.

In a further embodiment, the apparatus may contain a viewing mechanism configured to allow the user to view data reported to the CPU and data compiled by the compilation module. In one embodiment, the viewing mechanism allows the user to view real-time data from the knee pad, foot pad, arm and harness sensors.

In a further embodiment, the CPU can be set to emit an audible noise for movements registered by the knee pad, foot pad, arm and harness sensors. In another embodiment, the user is given a card that stores sensor data and compiled sensor data from past workouts, trainer instructions, workout schedules for the user and comparisons of past workouts.

A system of the present invention is also presented to accurately measure, compile, and present sprinting and running technique data. The system may contain, in one embodiment, a knee pad containing a knee pad sensor, a foot pad containing a foot pad sensor, a main trunk connecting the foot pad and the knee pad and a compilation module contained in a CPU. The knee pad sensor senses movement near the knee pad sensor and contact to the knee pad sensor and reports movement and contact data to the CPU. The foot pad sensor senses movement near the foot pad sensor and contact to the foot pad sensor and reports movement and contact data to the CPU. The compilation module compiles and organizes sensor data and outputs sensor data in a format readable by the user.

A method of the present invention is also presented for accurately measuring, compiling, and presenting sprinting and running data. The method in the disclosed embodiments substantially includes the steps necessary to carry out the functions presented above with respect to the operation of the described apparatus and system. In one embodiment, the method includes providing a knee pad containing a knee pad sensor. The knee pad sensor senses movement near the knee pad sensor and contact to the knee pad sensor and reports movement and contact data to a CPU. The method also may include providing a foot pad containing a foot pad sensor. The foot pad sensor senses movement near the foot pad sensor and contact to the foot pad sensor and reports movement and contact data to a CPU.

In a further embodiment, the method includes providing a main trunk configured to connect the foot pad and the knee pad. The method may also include standing on the foot pad, running in place and contacting the foot pad with feet, and contacting the knee pads with knees. The method may include reporting knee pad sensor data and foot pad sensor data to a CPU. The method may also include compiling sensor data in a compilation module of the CPU and outputting sensor data in a format readable by a user.

The apparatus, in one embodiment, includes a means for sensing movement of the knee of a user and contact from the knee of the user, a means for sensing movement of the feet of the user and contact from the feet of the user and a means for holding the means for sensing movement of the knee of a user and contact from the knee of the user above the means for sensing movement of the feet of the user and contact from the feet of the user.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 4 is a drawing of several readings by the foot pad sensor of the athletic training device in accordance with the present invention;

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of force readings, sensor orientation, sensor technology, pad orientation etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
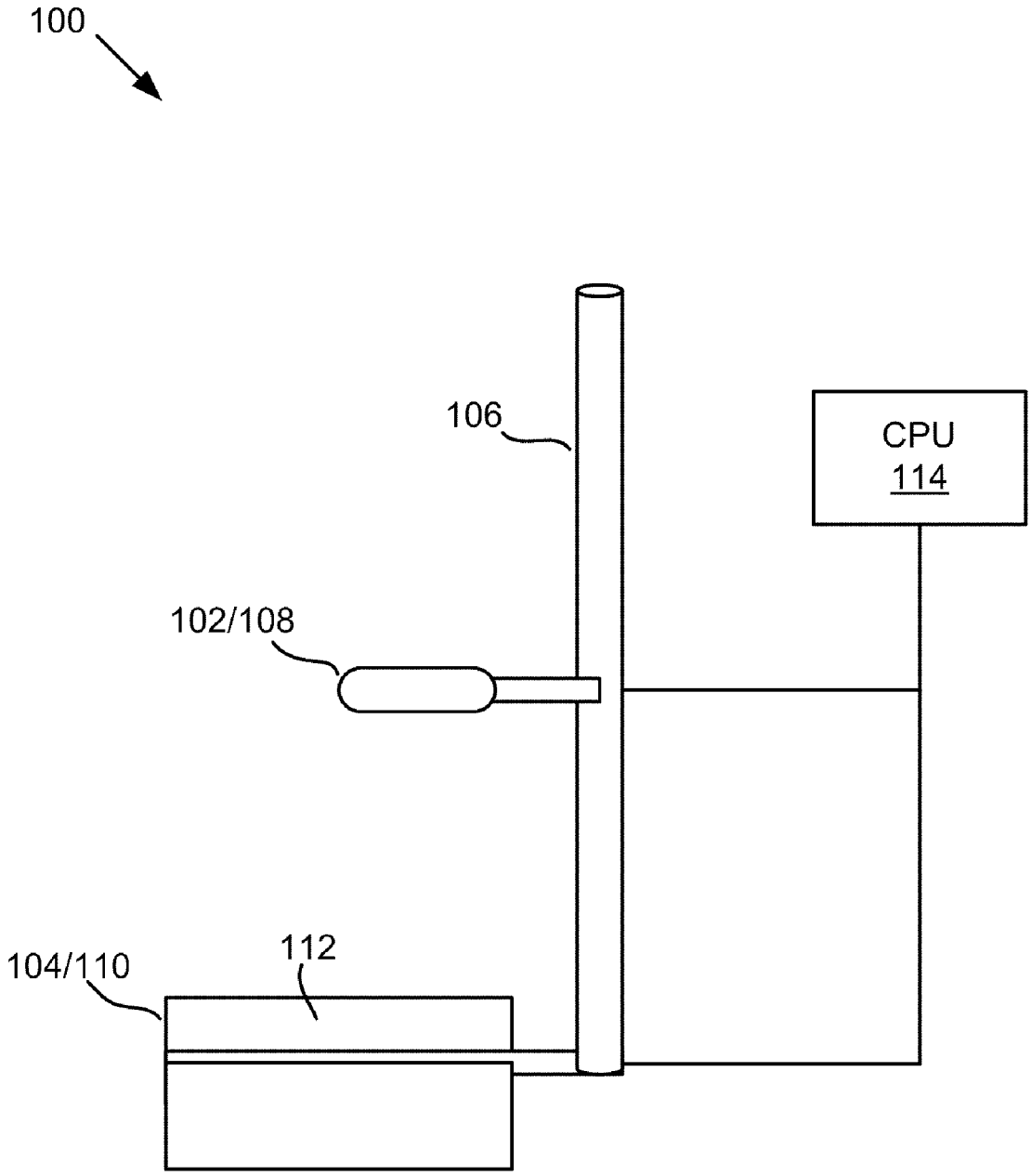
FIG. 1 is a side view illustrating one embodiment of an athletic training device in accordance with the present invention.

FIG. 1 is a side view of one side of one embodiment of an athletic training device 100 in accordance with the present invention. The athletic training device 100 includes a knee pad 102, a foot pad 104 and a main trunk 106. The main trunk 106 connects the foot pad 104 and the knee pad 102.

The figure shows an embodiment in which the foot pad 104 is located in a horizontal plane and the knee pad 102 is located in a parallel horizontal plane above the foot pad 104. A horizontal plane is a plane that extends horizontally. In one embodiment, the location and the angle of the foot pad 104 and the knee pad 102 are adjustable on the main trunk 106. In one embodiment, the knee pad 102 is adjustable in the vertical direction. In another embodiment, the knee pad 102 can be angled with regard to the horizontal plane. For example, the knee pad 102 may be positioned at a higher position for a taller user. Also, the knee pad 102 and the foot pad 104 may be angled forward to simulate the start phase and drive phase of a sprint.

In one embodiment, the knee pad 102 and the foot pad 104 are attached to the main trunk 106 though attachment mechanisms. The attachment mechanisms secure the position of the knee pad 102 and foot pad 104 and can be released to move the knee pad 102 and foot pad 104 to different locations. In one embodiment, the securing mechanism includes a plurality of evenly spaced holes disposed in the main trunk 106. A pin is placed through one of the plurality of holes in the main trunk 106 and through a hole in the attachment mechanism fixed to the knee pad 102.

In one embodiment, the knee pad 102 and foot pad 104 are held in a substantially fixed position while the athletic training device 100 is in use. In another embodiment, the knee pad 102 and the foot pad 104 are allowed to move slightly while the athletic training device 100 is in use.

In one embodiment, the knee pad 102 includes a knee pad sensor 108. The knee pad sensor 108 senses movement near and contact with the knee pad 102. In one embodiment, the knee pad sensor 108 includes a strain gage that registers the amount of force produced during a contact with the knee pad sensor 108. In another embodiment, the knee pad sensor 108 includes radar technology that measures the speed of the user's knee as it approaches the knee pad sensor 108. In this embodiment, the user need not touch the knee pad sensor 108 in order to trigger the knee pad sensor 108.

In one embodiment, the knee pad sensor 108 is positioned on the underside of the knee pad 102. In another embodiment, the knee pad sensor 108 is positioned at the joint between the knee pad 102 and the main trunk 106. In another embodiment, the knee pad sensor 108 covers the entire knee pad 102. In another embodiment, the knee pad sensor 108 is integrated in the knee pad 102. In another embodiment, the knee pad sensor 108 is located on the lateral end of the knee pad 102 and comprises radar technology. In one embodiment, the knee pad sensor is located on top of the knee pad.

In one embodiment, the foot pad 104 includes a foot pad sensor 110. In one embodiment, the foot pad 104 includes a substantially flat, rectangular pad. In another embodiment, the foot pad 104 includes two substantially flat, rectangular pads. In one embodiment, the foot pad sensor 110 is positioned on the upper surface of the foot pad 104. In another embodiment, the foot pad sensor 110 substantially covers the upper surface 112 of the foot pad 104. In another embodiment, the foot pad sensor 110 encircles the foot pad 104. In another embodiment, the foot pad sensor 110 is located under the foot pad 104. In another embodiment, the foot pad sensor 110 is integrated in the foot pad 104. In one embodiment, both the knee pad sensor 108 and the foot pad sensor 110 output sensor data to a CPU 114. The CPU 114 then outputs data to an output 115.

Figure 2:
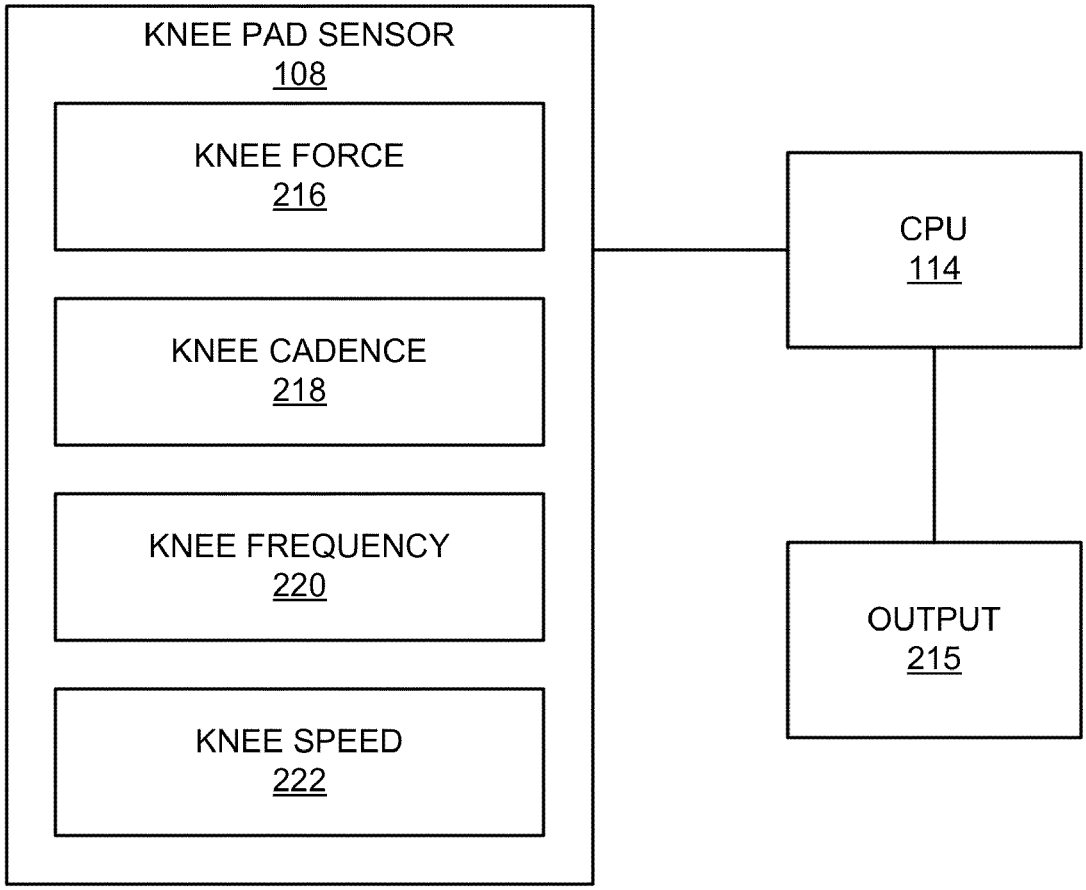
FIG. 2 is a schematic block diagram illustrating the knee pad sensor of the athletic training device in accordance with the present invention.

FIG. 2 is a schematic block diagram depicting the knee pad sensor 108 of athletic training device 100 in accordance with the present invention. In one embodiment, the knee pad 102 contains a knee pad sensor 108 which senses contact or movement near the knee pad sensor 108 and reports contact and movement data to a CPU 114. In one embodiment, the knee pad sensor 108 measures knee force 216, knee cadence 218, knee frequency 220 and knee speed 222 of the user's knees. In one embodiment, the knee pad sensor 108 measures the knee force 216 of the user's knee by measuring the force exerted when the user's knee contacts the knee pad sensor 108. In another embodiment, the knee pad sensor 108 measures the knee force 216 of the user's knee by measuring the knee speed 222 of the user's knee as it approaches the knee pad sensor 108. The knee speed 222 of the user's knee can be used in combination with the user's weight information to produce a knee force 216 measurement.

In one embodiment, the knee pad sensor 108 measures the knee cadence 218 of the user's knee by measuring the time between contacts to the knee pad sensor 108 by the user's knee. In another embodiment, the knee pad sensor 108 measures the knee cadence 218 of the user's knee by measuring the time between times when the user's knee reaches a high point. In one embodiment, the knee pad sensor 108 measures the time when the user's knee reaches a high point using radar technology. A high point is measured each time the user's knee approaches the knee pad 102 and comes to a complete stop before returning for the remained of the user's knee stride.

In one embodiment, the knee pad sensor 108 measures the knee frequency 220 of the user's knee stride. In one embodiment, the knee pad sensor 108 measures the knee frequency 220 of the user's knee stride by measuring the number of contacts on the knee pad sensor 108 during a specified period of time. In another embodiment, the knee pad sensor 108 measures the knee frequency 220 of the user's knee stride by measuring the number of points when the user's knee reaches a high point during a specified period of time.

Figure 3:
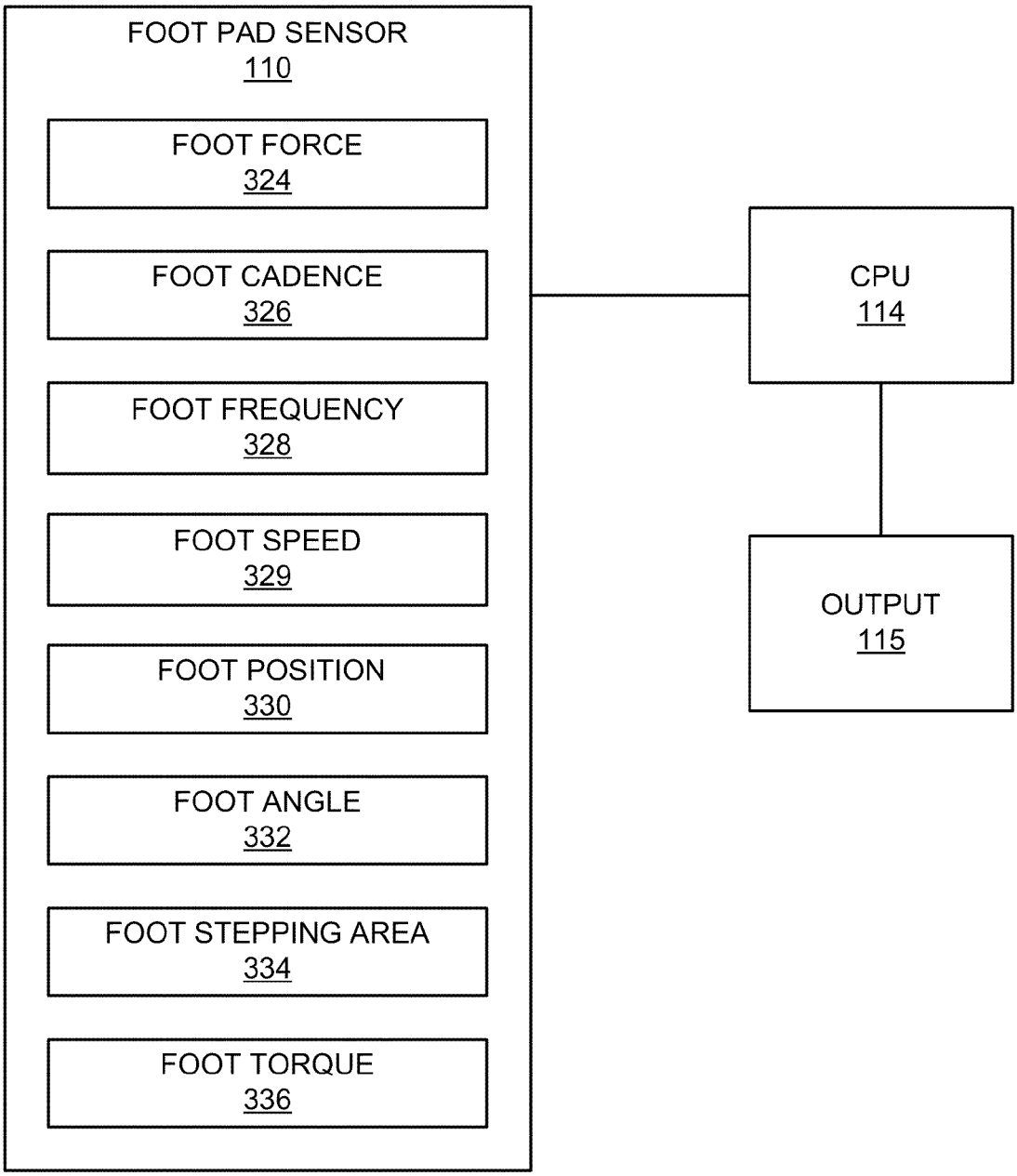
FIG. 3 is a schematic block diagram depicting the foot pad sensor of the athletic training device in accordance with the present invention.

FIG. 3 is a schematic block diagram depicting one embodiment of the foot pad sensor 110 of the athletic training device 100 in accordance with the present invention. In one embodiment, the foot pad 104 contains a foot pad sensor 110 which senses movement near the foot pad sensor 110 and contact on the foot pad sensor 110 and reports movement and contact data to the CPU 114. The CPU 114 then outputs data to an output 115. In one embodiment, the foot pad sensor 110 measures foot force 324, foot cadence 326, foot frequency 328 and foot torque 336 of the user's feet. In one embodiment, the foot pad sensor 110 measures foot force 324 by measuring the force exerted by the user's feet on the foot pad sensor 110. In another embodiment, the foot pad sensor 110 measures foot force 324 by measuring the speed of the user's foot as the user's foot approaches the foot pad sensor 110. In one embodiment, the foot pad sensor 110 measures the speed of the user's foot as the user's foot approaches the foot pad sensor 110 through the use of radar technology.

In one embodiment, the foot pad sensor 110 measures the foot cadence 326 of the user's feet by measuring the time between contacts on the foot pad sensor 110 by the user's feet. In another embodiment, the foot pad sensor 110 measures the foot cadence 326 of the user's feet by measuring the time between points when the user's foot slows to a stop as the user's foot contacts the foot pad 104.

In one embodiment, the foot pad sensor 110 measures the foot frequency 328 of strides of the user's foot by measuring the number of contacts on the foot pad sensor 110 by the user's feet during a specified period of time. In another embodiment, the foot pad sensor 110 measures the foot frequency 328 of strides of the user's foot by measuring the number of points when the user's foot slows to a stop as the user's foot contacts the foot pad 104. In one embodiment, the foot pad sensor 110 also measures foot speed 329, foot position 330, foot angle 332, and foot stepping area 334.

FIG. 4 is a drawing of several possible readings by the foot pad sensor 110 of the athletic training device 100 in accordance with the present invention. In one embodiment, the foot pad sensor 110 measures the foot position 330 of the user's foot as it contacts or approaches the foot pad 104. FIG. 4 shows several readings of the foot pad sensor 110 while the user stands or runs in place on the foot pad sensor 110. Each reading shows the positioning of the user's feet. FIG. 4D shows that the user's feet are not exactly aligned in position. In one embodiment, misalignment of the user's feet is an error that is reported to the CPU 114.

In one embodiment, the foot pad sensor 110 measures the foot angle 332 of the user's foot as it contacts or approaches the foot pad 104. FIG. 4A shows that the feet of the user are parallel to each other during the running motion. FIG. 4B shows that the right foot 440 of the user is at an angle to the left foot 438 of the user.

In another embodiment, the foot pad sensor 110 measures the foot stepping area 334 of the user's foot as it contacts or approaches the foot pad 104. FIGS. 4A and 4B show that substantially all of the user's foot contacts the foot pad sensor 110 during the running motion. This may be appropriate for a running motion but may not be appropriate for a sprinting motion. FIGS. 4C and 4D show that a front portion of the user's foot contacts the foot pad sensor 110 while the back portion of the user's foot does not contact the foot pad sensor 110. FIG. 4E shows that the user's toes do not contact the foot pad sensor 110. FIG. 4F shows that only the exterior of the user's foot contacts the foot pad sensor 110 which may be indicative of high arched feet and the need for special running shoes. This data is used by the athletic training device 100 to determine if the user is contacting the ground with the proper form during a sprint or run. During a sprint, for example, only the front portion of the user's feet should contact the ground and each of the feet should be substantially parallel.

Figure 5:
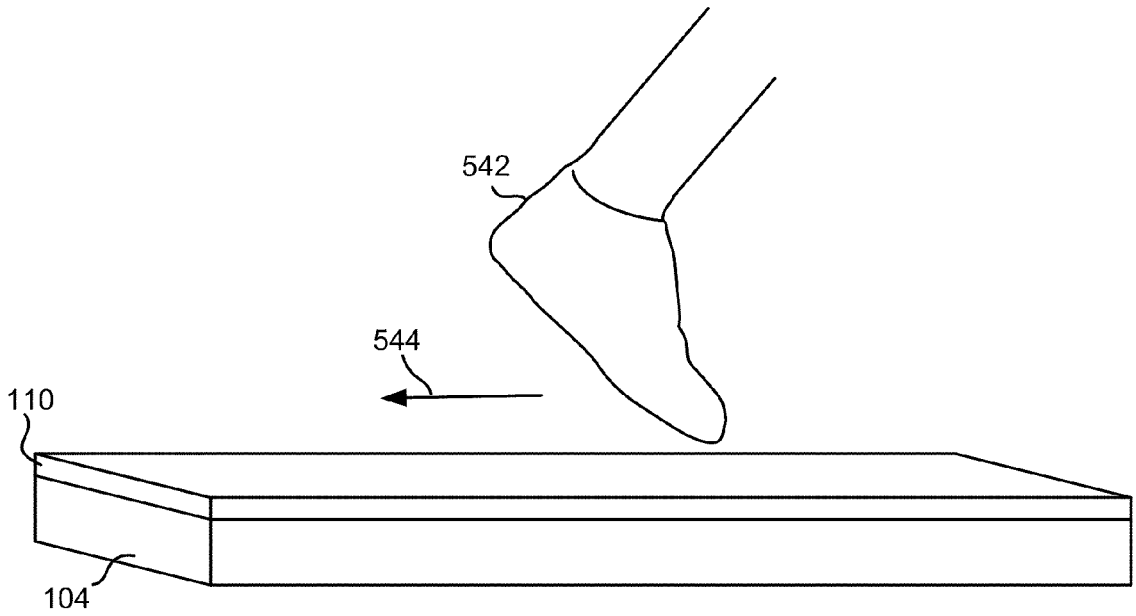
FIG. 5 is a drawing of a user's foot as it approaches the foot pad of the athletic training device in accordance with the present invention.

FIG. 5 is a drawing of a user's foot 542 as it approaches the foot pad 104 of the athletic training device 100 in accordance with the present invention. In one embodiment, the foot pad sensor 110 measures the foot torque 336 produced by the user's foot 542 as the user's foot 542 contacts the foot pad sensor 110. In one embodiment, the foot pad sensor 110 is allowed to move in a direction 544 with relation to the foot pad 104 to measure the foot torque 336 produced by the foot of the user. In another embodiment, the foot pad sensor 110 measures foot torque 336 by measuring the backwards speed of the user's foot as the user's foot approaches the foot pad sensor 110. This data may be used by the athletic training device 100 to determine if the user produces sufficient negative foot speed. For optimal sprinting speed, the negative foot speed should match the forward speed of the athlete's center of gravity in order to avoid breaking forces.

Foot movement can also be detected and measured using other types of sensors, including optical technology. For instance, lasers can be used to detect foot movement, placement, and speed. Force can be determined by speed and acceleration of the foot.

Figure 6:
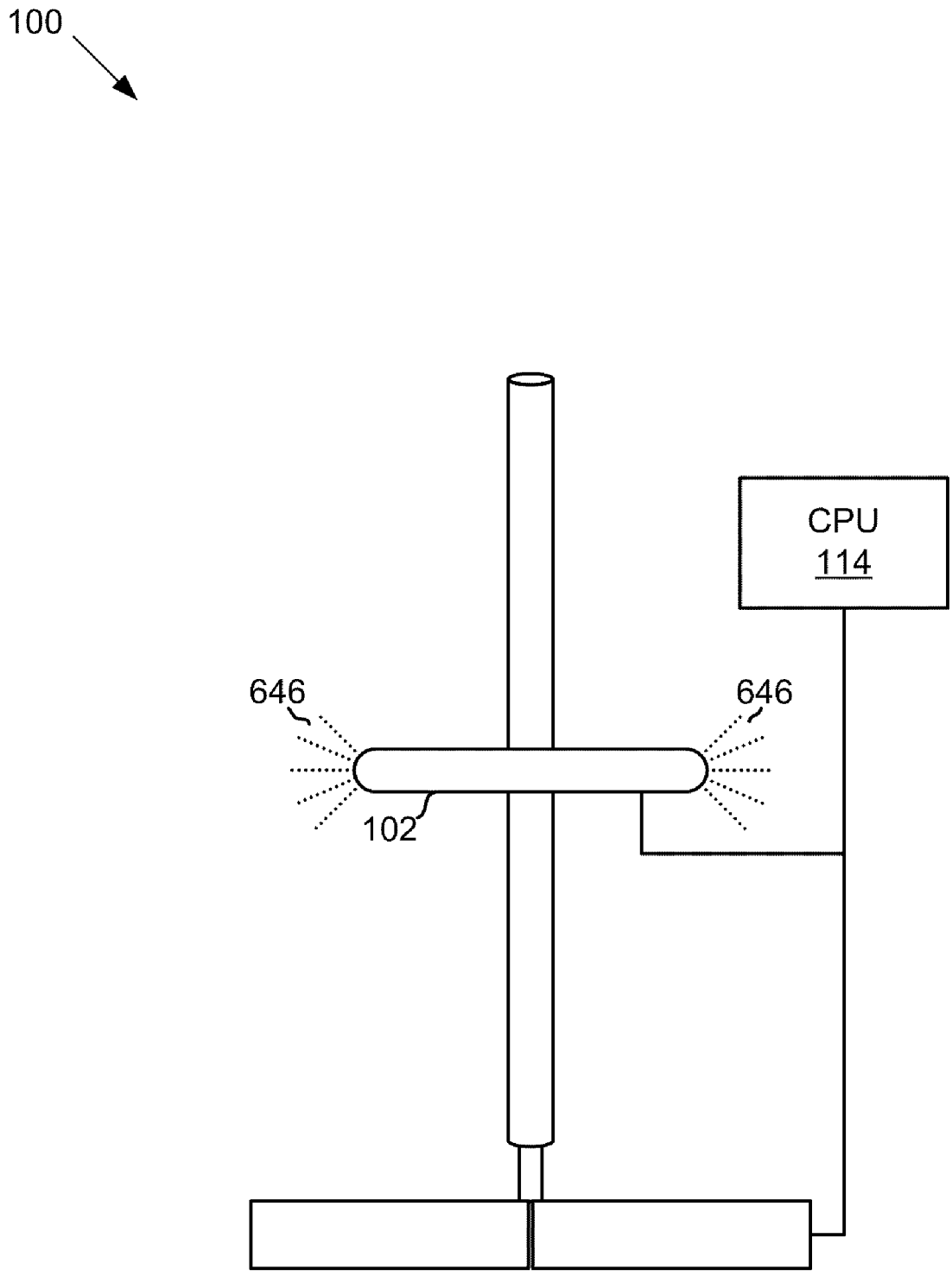
FIG. 6 is a front view of an embodiment of the athletic training device which contains arm sensors disposed in the knee pad in accordance with the present invention.

FIG. 6 is a front view of one embodiment of the athletic training device 100 which contains arm sensors 646 disposed in the knee pad 102 in accordance with the present invention. In one embodiment, the arm sensors 646 sense arm movement of the user and report arm movement data to the CPU 114. In one embodiment, the arm sensors 646 include radar technology. In one embodiment, the arm sensors 646 include motion sensing technology. Optical and laser detection can also be used.

In one embodiment, the arm sensors 646 are located on the lateral ends of the knee pad 102 facing away from the main trunk 106. The user swings the user's arms past the arm sensors 646 during each arm stride. In another embodiment, the arm sensors 646 are located on the main trunk 106. In another embodiment, the arm sensors 646 are remotely located and can be positioned on objects surrounding the apparatus 100. In another embodiment, the arm sensors 646 are located in the foot pad 104. In another embodiment, the arm sensors 646 are located under the knee pad 102. In another embodiment, the arm sensors 646 are located over the knee pad 102.

Figure 7:
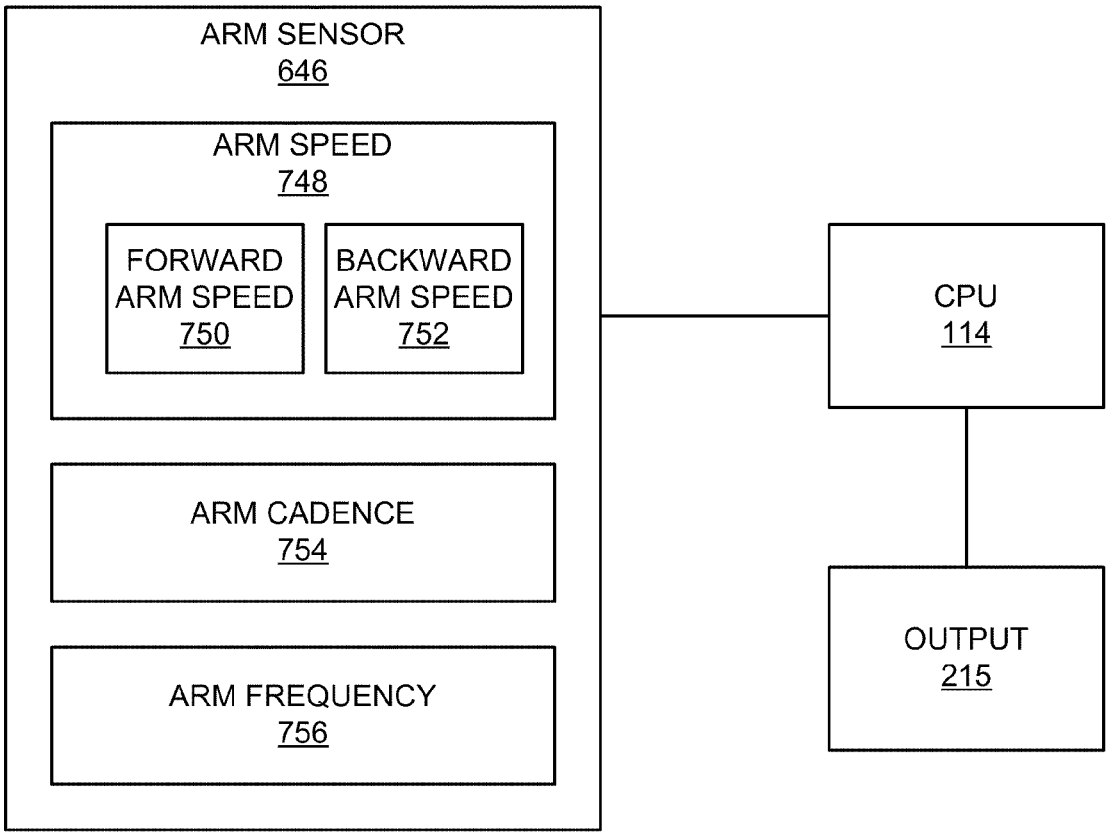
FIG. 7 is a schematic block diagram depicting one embodiment of the arm sensor of the athletic training device in accordance with the present invention.

FIG. 7 is a schematic block diagram depicting one embodiment of the arm sensors 646 of the athletic training device 100 in accordance with the present invention. In one embodiment, the arm sensors 646 output arm sensor data to the CPU 114. The CPU 114 outputs compiled arm sensor data to the output 115. In one embodiment, the arm sensor 646 measures the arm speed 748 of the users arms as the user's arms pass the arm sensors 646. In another embodiment, the arm sensors 646 measure the forward arm speed 750 of the user's arms during the forward motion of the user's arms as well as the backward arm speed 752 of the user's arms during the backward motion of the user's arms. This data may be used by the user to insure that the backward arm speed 752 is substantially the same as the forward arm speed 750.

In one embodiment, the arm sensors 646 measure the arm cadence 754 of the user's arms by measuring the time between points at which the user's arm passes the arm sensor 646. In another embodiment, the arm sensors 646 measure the arm frequency 756 of the user's arm stride by measuring the number of points at which the user's arm passes the arm sensor 646 during a specified period of time.

Figure 8:
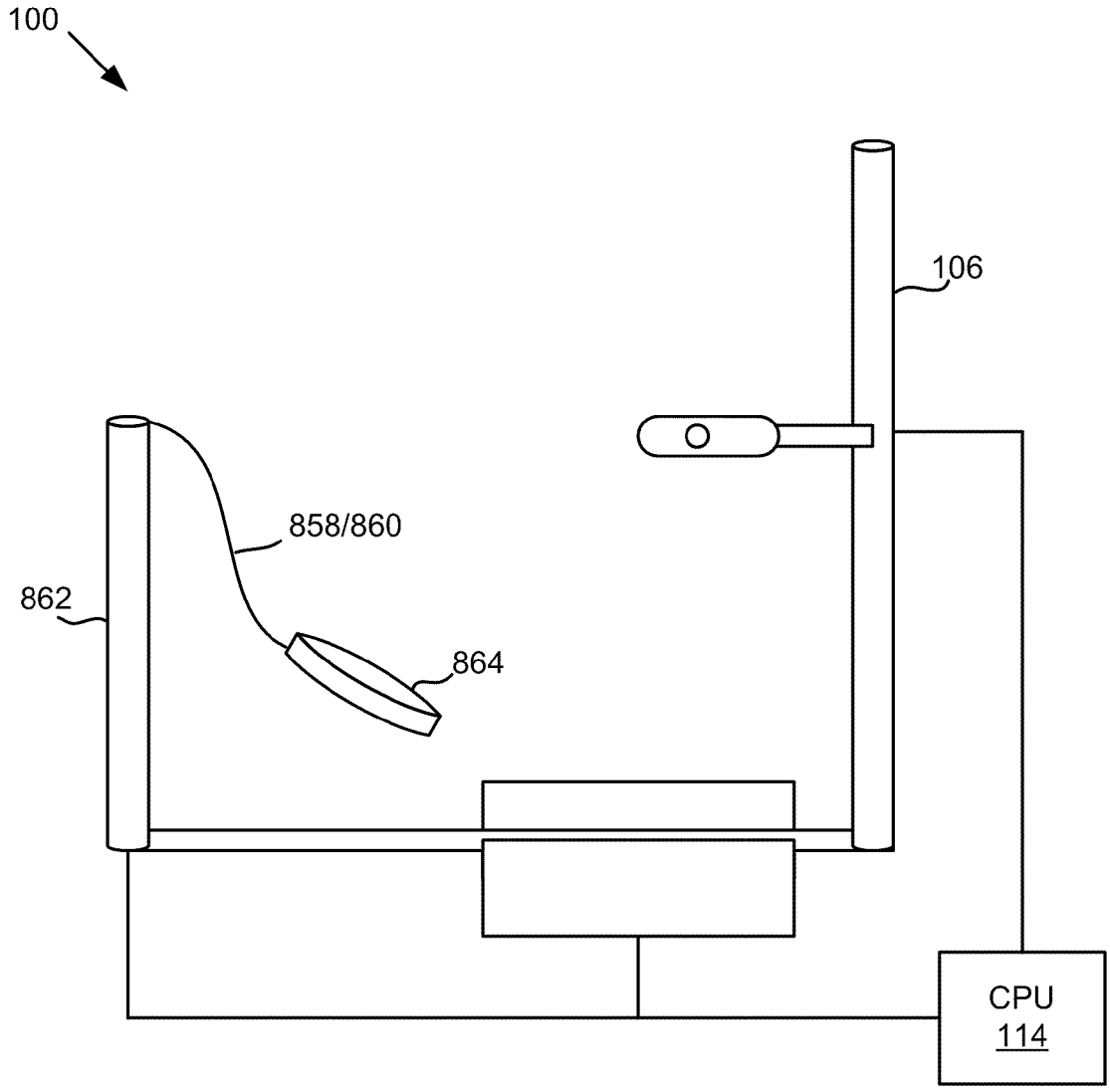
FIG. 8 is a drawing of an embodiment of the athletic training device which contains a harness in accordance with the present invention.

FIG. 8 is a drawing of one embodiment of the athletic training device 100 which contains a harness 858 in accordance with the present invention. The harness 858 is positioned opposite from the main trunk 106. In one embodiment, the harness 858 is attached to a second trunk 862. The second trunk 862 is parallel to the main trunk 106. In one embodiment, the second trunk 862 contains supporting beams to further secure the second trunk 862. In another embodiment, the harness 858 is remotely attached to an object near the apparatus 100. In another embodiment, the harness 858 is attached to the foot pad 104. In another embodiment, the harness 858 is attached behind the foot pad 104, near the ground upon which the apparatus 100 is placed.

In one embodiment, the second trunk 862 contains several attachment points for the harness 858. The attachment points may be used to attach the harness 858 at different points on the second trunk 862. The attachment points may also be used to attach resistance bands which are secured to the user.

In one embodiment, the harness 858 contains a harness sensor 860 that reports data to the CPU 114. In one embodiment, the harness sensor 860 forms the attachment between the harness 858 and the second trunk 862. In another embodiment, the harness sensor 860 is contained within the harness 858.

In one embodiment, the harness 858 contains a belt 864 which is secured around the waist of the user. In another embodiment, the harness 858 contains securing mechanisms to secure the harness 858 to different positions on the user. In one embodiment, the harness sensor 860 consists of a plurality of strain gages.

Figure 9:
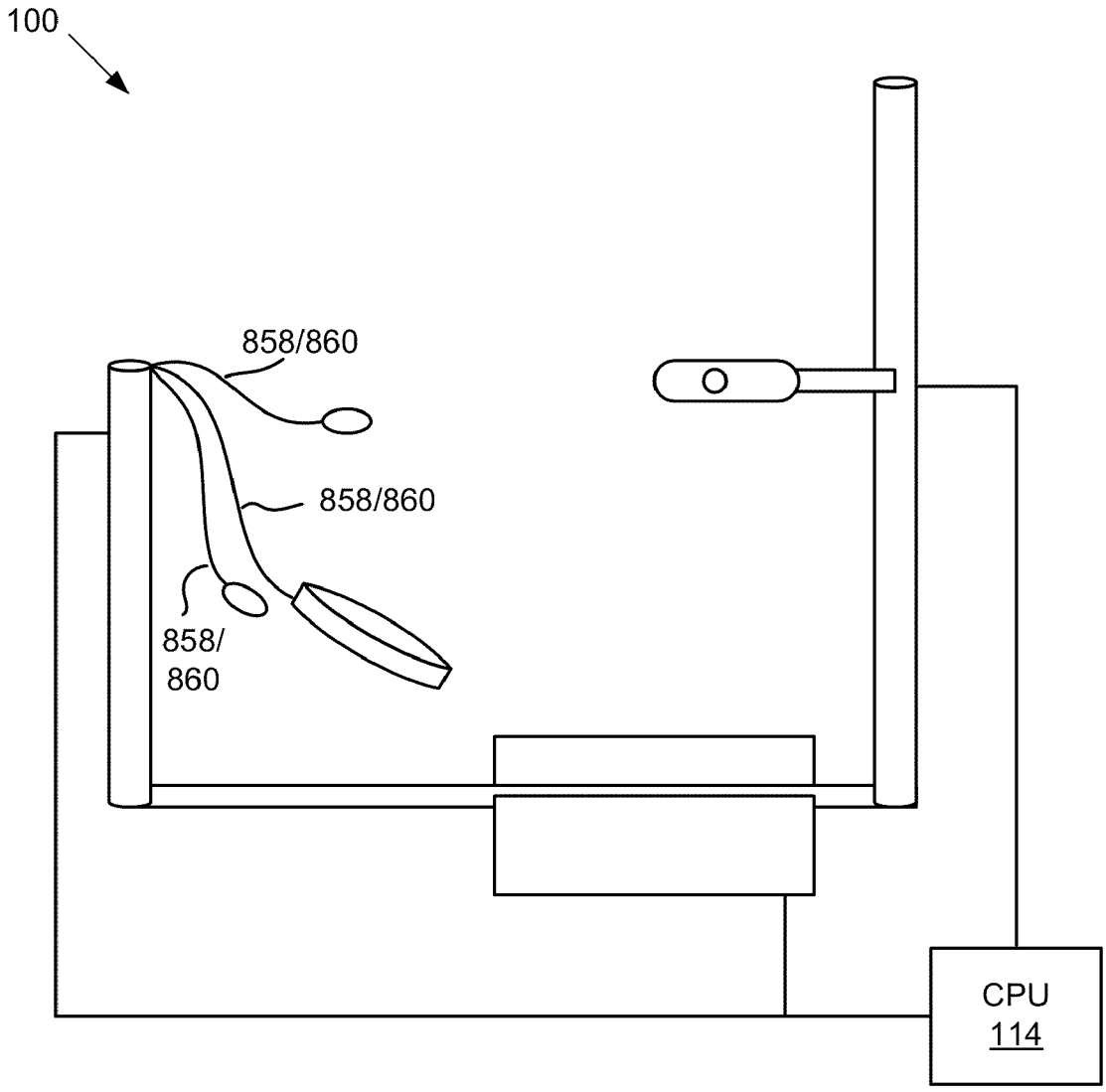
FIG. 9 is a drawing of one embodiment of the athletic training device which contains a plurality of harnesses in accordance with the present invention.

FIG. 9 is a drawing of one embodiment of the athletic training device 100 which contains a plurality of harness 858 which connect with portions of the athletes back. In one embodiment, the plurality of harnesses 858 each contain harness sensors 860. The plurality of harness sensors 860 give a posture measurement of the user.

Figure 10:
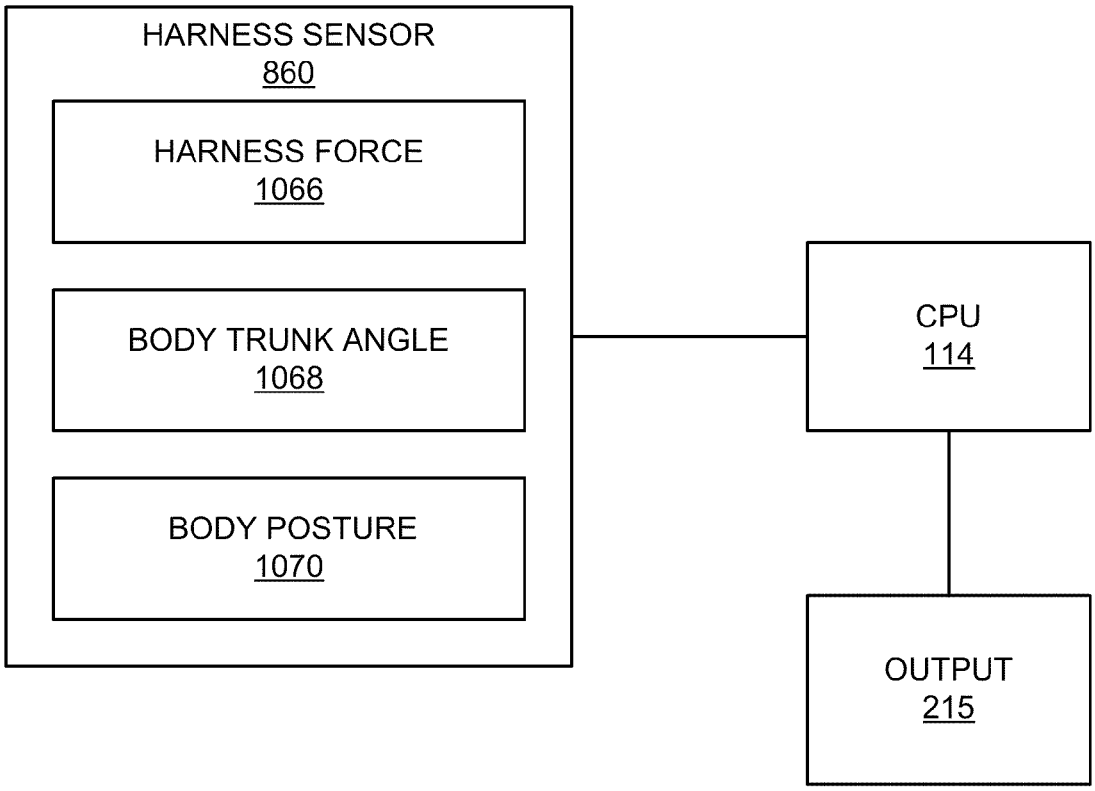
FIG. 10 is a schematic block diagram of the harness sensor of the athletic training device in accordance with the present invention.

FIG. 10 is a schematic block diagram of the harness sensor 860 of the athletic training device 100 in accordance with the present invention. In one embodiment, the harness sensor 860 measures harness force 1066, body trunk angle 1068 and body posture 1070 of the user. In one embodiment, the harness sensor 860 measures harness force 1066 by measuring the amount of force exerted by the user on the harness 858. In one embodiment, the harness sensor 860 measures body trunk angle 1068 and posture 1070 by comparing harness force 1066 exerted by the user on the harness 858 with specified force readings of a user with the proper body trunk angle 1068 and posture 1070. In another embodiment, the harness sensor 860 consists of a retractable harness 858. The retractable harness 858 measures body trunk angle 1068 and posture 1070 by comparing the length of harness 858 that is pulled from a retraction mechanism compared with specified lengths of the harness 858 for proper body trunk angles 1068 and posture 1070.

In one embodiment, the athletic training device 100 includes a video recording mechanism. The video recording mechanism is capable of video recording and displaying real-time video of the user while the user is using the apparatus. In one embodiment, the video recording mechanism includes a video recorder placed in front of the user within the main trunk 106. In another embodiment, the video recording mechanism is located remotely to record different perspectives of the user while the user is on the apparatus.

Figure 11:
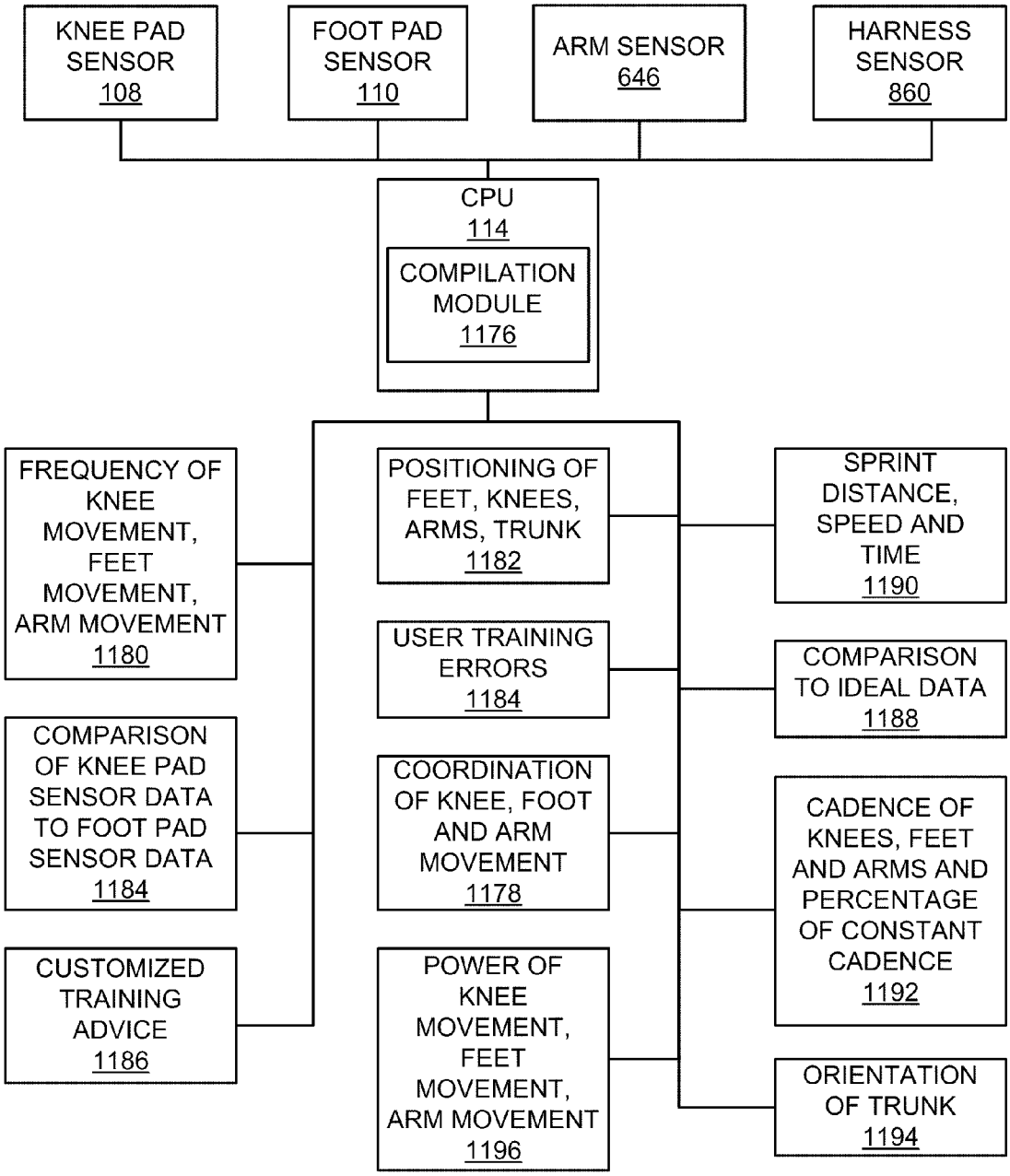
FIG. 11 is a schematic block diagram showing one embodiment of a CPU containing a compilation module.

FIG. 11 is a schematic block diagram showing one embodiment of a CPU 114 containing a compilation module 1176. In one embodiment, the compilation module 1176 performs a plurality of functions associated with compiling data obtained from each of the sensors. The compiled data provides data that can be used by the user to diagnose a plurality of running or sprinting errors 1184. For example, in one embodiment the compilation module 1176 outputs data comparing the coordination of foot, knee and arm movement 1178. Under another embodiment, the compilation module 1176 receives sensor data from the knee sensor 108 and arm sensors 646 and outputs data that is readable to the user. The data may include leg, arm and knee frequency 1180, power, position 1182, and orientation. The compilation module 1176 may compare these data categories over a specified exercise time 1184 and may compare these data from one workout session to another workout session. The data may be output for the user in the form of a line graph, a bar graph, percentages, explanation of training errors, or any other method that alerts the user to the user's sensor data.

In one embodiment, the compilation module 1176 outputs customized training advice 1186 and techniques for the user corresponding to sensor data received by the CPU 114. In another embodiment, the compilation module 1176 is programmed to output a comparison of frequency, force, torque and speed over a specified time period and to output a consistency percentage. This allows the athlete to see how these data change over a short spring or a longer run.

In one embodiment, the compilation module 1176 outputs a comparison of the user's sensor data to ideal sensor data 1188. The ideal sensor data may correspond to the user's weight, height, athletic ability, competition level or any other criteria. The ideal sensor data may be programmed to change over the training period so that the ideal starting phase data is compared to the starting phase of the user and the ideal drive phase and the ideal knee lift phase data are compared with the drive phase and knee lift phase of the user.

In one embodiment, the compilation module 1176 may also output sprint distance, speed and time 1190. In another embodiment, the compilation module 1176 may also output the cadence of knees, feet and arms and a percentage of consistency in those cadences 1192. In another embodiment, the compilation module 1176 may output the orientation of the user's trunk 1194. In still another embodiment, the compilation module 1176 may output the power of the knee movement, feet movement and arm movement 1196. These power outputs can be compared to optimize stride technique.

Figure 12:
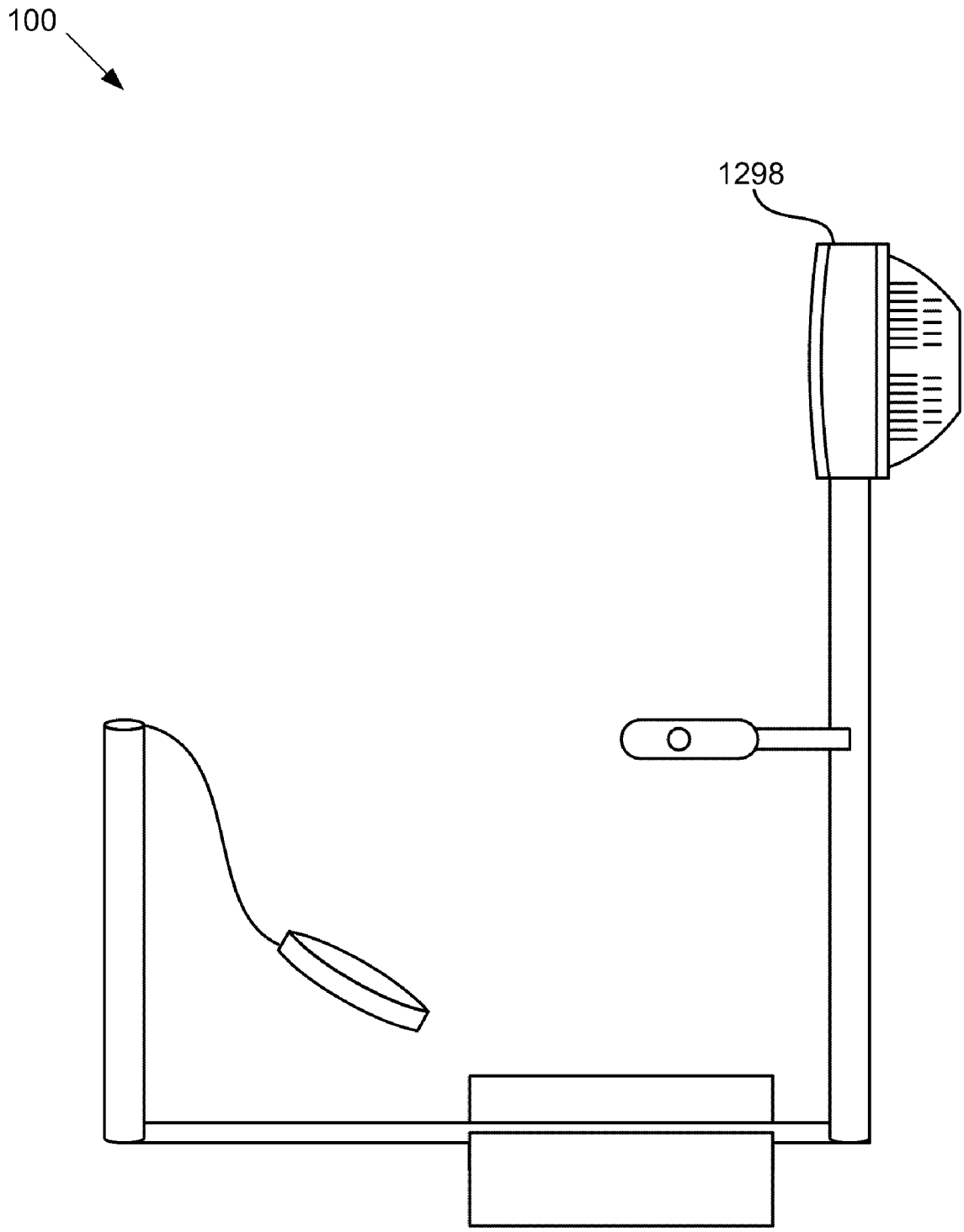
FIG. 12 is a drawing of a side view of one embodiment of the athletic training device which contains a viewing mechanism in accordance with the present invention.

FIG. 12 is a drawing of one embodiment of the athletic training device 100 which contains a viewing mechanism 1298. The viewing mechanism 1298 allows the user to view data reported to the CPU 114 and compiled by the compilation module 1176. In one embodiment, the data may be output and viewed by the user in real-time. In another embodiment, the data is output and viewed by the user after a workout. In another embodiment, the viewing mechanism shows the video recorded data from the video recording mechanism. In one embodiment, the viewing mechanism 1298 comprises part of the output 215.

Figure 13:
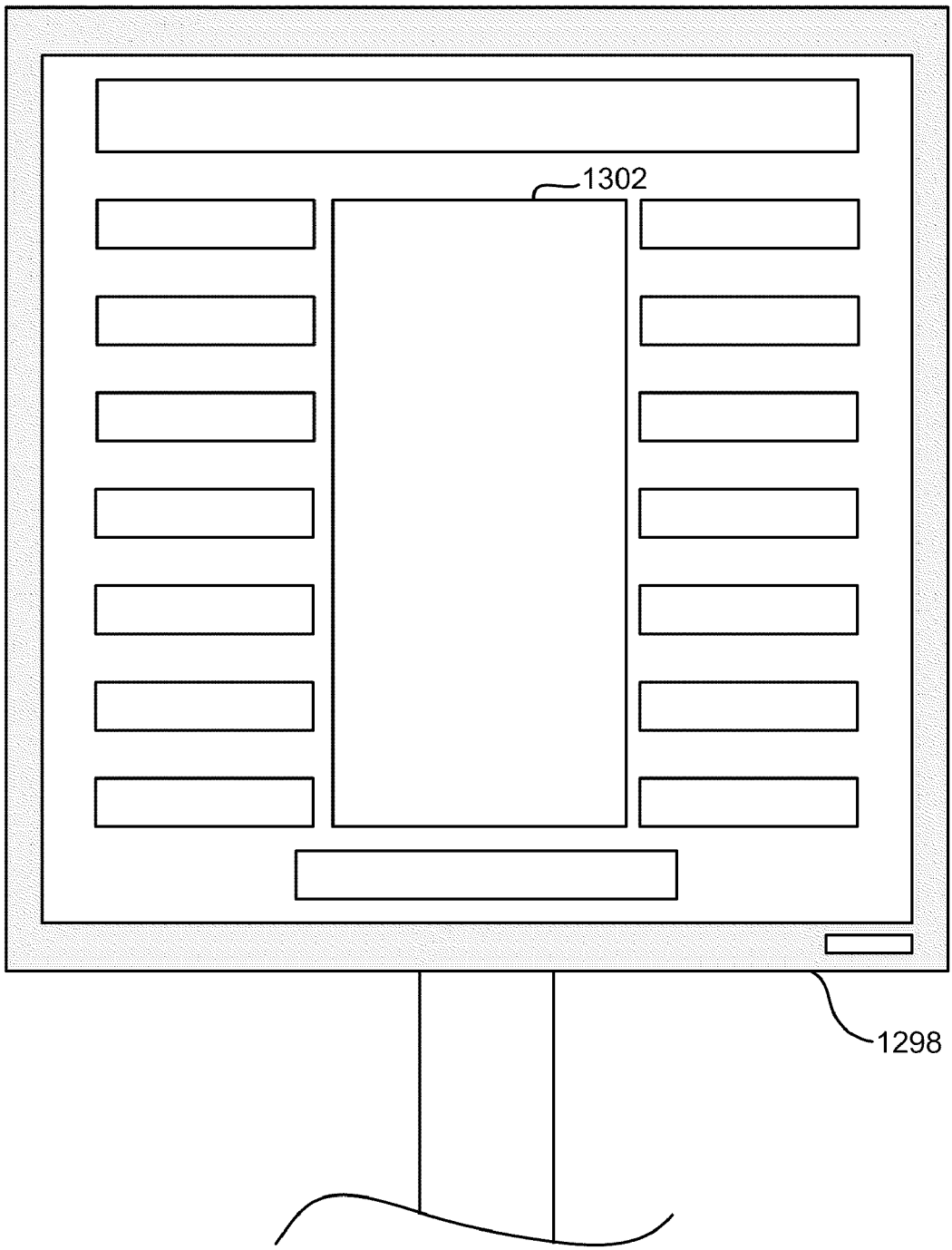
FIG. 13 is a drawing of one embodiment of a viewing device in accordance with the present invention.

FIG. 13 is a drawing of one embodiment of a viewing mechanism 1298 in accordance with the present invention. A video image of the user may appear in the center 1302 of the screen in real-time to allow the user to correct training errors and immediately see the results. Data such as foot speed 329, foot force 324, hand speed, arm speed 748, etc. may be displayed around the video image.

In one embodiment, the athletic training device 100 includes an audible noise mechanism that emits a noise for each movement registered by a sensor. The audible noise mechanism can be set to make a noise for any number of the sensors. For example, the user can hear the frequency of the noise emitted corresponding to the user's arm movement. The user can use the noise from the audible noise mechanism to assist the user in improving the cadence of the user's arms.

In one embodiment, the athletic training device 100 includes a card that stores sensor data and compiled sensor data from past workouts. The card may also store trainer instructions, workout schedules for the particular user, past sensor data, and other compiled data. In one embodiment, the card includes memory. In another embodiment, the card does not include memory but simply allows the user to access data stored in the CPU 114 of the athletic training device 100.

Figure 14:
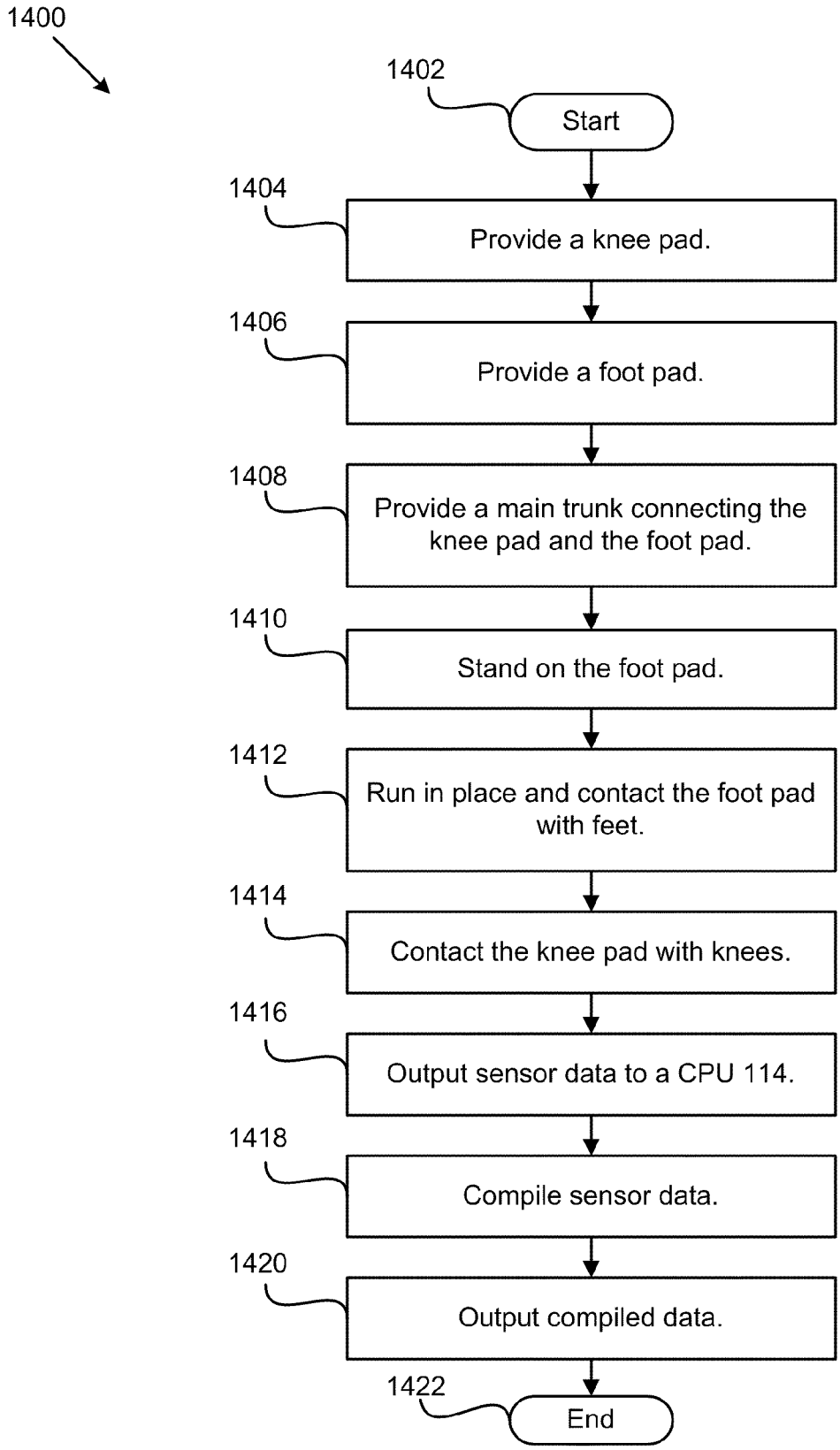
FIG. 14 is a schematic block diagram illustrating one embodiment of a method for accurately measuring, compiling, and presenting sprinting and running data in accordance with the present invention.

FIG. 14 is a schematic block diagram illustrating one embodiment of a method for accurately measuring, compiling, and presenting sprinting and running data in accordance with the present invention. In one embodiment, the method starts 1402 and provides 1404 a knee pad 102 containing a knee pad sensor 108. The knee pad sensor 108 senses movement near the knee pad sensor 108 and contact to the knee pad sensor 108 and reports movement and contact data to a CPU 114. The method then provides 1408 a foot pad 104 containing a foot pad sensor 110 which senses movement near the foot pad sensor 110 and contact to the foot pad sensor 110 and reports movement and contact data to the CPU 114. In one embodiment, the method provides 1408 a main trunk 106 configured to connect the foot pad 104 and the knee pad 102.

A user then stands 1410 on the foot pad 104 and runs 1412 in place and contacts the foot pad 104 with the user's feet. The foot pad sensor 110 senses the force produced by each step, the angle of each foot of the user, the step area of each step and the torque of each step. This data can be used by the user to improve running and sprinting form.

The user contacts 1414 the knee pad 102 with the user's knees. The knee pad sensor 108 and the foot pad sensor 110 output 1416 knee pad sensor 108 data and foot pad sensor 110 data to a CPU 114. The compilation module 1176 of the CPU 114 compiles 1418 the data received from the sensors. The data is compiled and output 1420 in a format that is readable by the user. The data can then be analyzed by the user and an athletic trainer to correct user errors and perfect running or sprinting form. The method 1400 then ends 1422.

In one embodiment, the athletic training device 100 includes a means for sensing movement of the knee of a user and contact from the knee of the user, a means for sensing movement of the feet of the user and contact from the feet of the user, and a means for holding the means for sensing movement of the knee of a user and contact from the knee of the user above the means for sensing movement of the feet of the user and contact from the feet of the user.

In one embodiment, the means for sensing movement of the knee of a user and contact from the knee of the user is configured to measure knee force, knee cadence and knee frequency and to output knee force, knee cadence and knee frequency data to the CPU 114. In another embodiment, a means for sensing movement of the feet of the user and contact from the feet of the user measures foot force, foot cadence, foot frequency and foot torque and outputs foot force, foot cadence, foot frequency and foot torque data to the CPU 114. In another embodiment, the means for sensing movement of the feet of the user and contact from the feet of the user senses foot position on the foot pad 104, foot angle on the foot pad 104 and foot stepping area on the foot pad 104. The means for sensing movement of the feet of the user and contact from the feet of the user may also measure foot torque wherein foot torque comprises negative foot speed and force.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to train athletes, the apparatus comprising:

a knee pad comprising a knee pad sensor, wherein the knee pad sensor senses movement near the knee pad sensor and contact to the knee pad sensor and reports movement and contact data to a CPU;

a foot pad comprising a foot pad sensor, wherein the foot pad sensor senses movement near the foot pad sensor and contact to the foot pad sensor and reports movement and contact data to the CPU;

a main trunk configured to connect the foot pad and the knee pad; wherein a user can stand on the foot pad, run in place contacting the foot pad with their feet and contacting the knee pad with their knees; and compiling knee pad sensor data and foot pad sensor data in a compilation module of the CPU.

2. The apparatus of claim 1, wherein the foot pad is located in a horizontal plane and the knee pad is located in a parallel plane above the foot pad, the main trunk connecting the foot pad and the knee pad and maintaining the position of the knee pad with respect to the foot pad.

3. The apparatus of claim 1, wherein the location and angle of the foot pad and the knee pad are adjustable on the main trunk.

4. The apparatus of claim 1, wherein the knee pad sensor is configured to measure knee force, knee cadence and knee frequency and to output knee force, knee cadence and knee frequency data to the CPU.

5. The apparatus of claim 1, wherein the foot sensor is configured to measure foot force, foot cadence, foot frequency and foot torque and to output foot force, foot cadence, foot frequency and foot torque data to the CPU.

6. The apparatus of claim 5, wherein the foot pad sensor is further configured to sense foot position on the foot pad, foot angle on the foot pad and foot stepping area on the foot pad.

7. The apparatus of claim 6, wherein the foot pad sensor is further configured to measure foot torque, wherein foot torque comprises negative foot speed and force.

8. The apparatus of claim 1, further comprising arm sensors configured to sense arm movement of a user, wherein the arm sensors report arm sensor data to the CPU.

9. The apparatus of claim 8, wherein the arm sensors are configured to measure arm speed, arm cadence and arm frequency and to output arm speed, arm cadence and arm frequency data to the CPU, wherein arm speed comprises forward arm speed and backward arm speed.

10. The apparatus of claim 8, further comprising a harness, the harness positioned opposite the main trunk.

11. The apparatus of claim 10, wherein the harness comprises a harness sensor configured to report harness sensor data to the CPU.

12. The apparatus of claim 11, wherein the harness is configured to measure harness force, body trunk angle and body posture and to output harness force, body trunk angle and body posture data to the CPU.

13. The apparatus of claim 12, wherein the harness comprises a plurality of harnesses connected with portions of a user's back, the plurality of harnesses configured to output a body posture measurement to the CPU.

14. The apparatus of claim 10, further comprising a video recording mechanism capable of video recording and outputting real-time video of a user while the user is running or sprinting in place on the apparatus.

15. The apparatus of claim 14, wherein the compilation module compiles and organizes sensor data and outputs sensor data, wherein sensor data comprises data output by the knee pad sensor, the foot pad sensor, the arm sensors, the harness sensor and the video recording mechanism.

16. The apparatus of claim 15, wherein the compilation module detects user training errors, wherein detecting user training errors comprises comparing knee pad sensor data with foot pad sensor data to measure coordination of foot and knee movement.

17. The apparatus of claim 15, wherein the compilation module receives sensor data and outputs user readable data comprising frequency, power, position, and orientation, wherein the compilation module also outputs coordination data between feet, knees and arms and compares sensor data over a specified time period.

18. The apparatus of claim 15, wherein compilation module compiles sensor data and outputs customized training advice and techniques for the user corresponding to sensor data received by the CPU.

19. The apparatus of claim 15, wherein the compilation module compares frequency, force, torque and speed over a specified time period and give a percentage corresponding to the consistency of each of frequency, force, torque and speed.

20. The apparatus of claim 15, wherein the compilation module compares the user's sensor data to ideal sensor data for each phase of a sprint.

21. The apparatus of claim 15, further comprising a viewing mechanism that displays real-time data from the knee, foot, arm and harness sensors and the video recording mechanism.

22. A method for accurately measuring, compiling, and presenting sprinting and running data, the method comprising:

providing a knee pad configured to contain a knee pad sensor wherein the knee pad sensor senses movement near the knee pad sensor and contact to the knee pad sensor and reports movement and contact data to a CPU;

providing a foot pad configured to contain a foot pad sensor wherein the foot pad sensor senses movement near the foot pad sensor and contact to the foot pad sensor and reports movement and contact data to the CPU; and providing a main trunk configured to connect the foot pad and the knee pad;

standing on the foot pad;

running in place and contacting the foot pad with feet;

contacting the knee pads with knees;

reporting knee pad sensor data and foot pad sensor data to the CPU;

compiling knee pad sensor data and foot pad sensor data in a compilation module of the CPU; and outputting compiled sensor data in a format readable by a user.

23. An apparatus to train athletes, the apparatus comprising:

a knee pad configured to contain a knee pad sensor wherein the knee pad sensor senses movement near the knee pad sensor and contact to the knee pad sensor and reports movement and contact data to a CPU;

a foot pad configured to contain a foot pad sensor wherein the foot pad sensor senses movement near the foot pad sensor and contact to the foot pad sensor and reports movement and contact data to the CPU;

a main trunk configured to connect the foot pad and the knee pad;

arm sensors configured to sense arm movement of a user situated in the knee pad, the arm sensors reporting data to the CPU;

a harness positioned opposite the main trunk, wherein the harness contains a harness sensor configured to report harness sensor data to the CPU;

a compilation module of the CPU, wherein the compilation module compiles and organizes sensor data and outputs sensor data, wherein sensor data comprises data output from the knee pad sensor, the foot pad sensor, the arm sensors, and the harness sensor; and a viewing mechanism configured to allow the user to view data reported to the CPU and data compiled by the compilation module.

* * * * *